United States Patent [19]

Vogelzang

[11] Patent Number: 4,838,482

[45] Date of Patent: Jun. 13, 1989

[54] AIR CONDITIONING SYSTEM WITH PERIODIC FAN OPERATION

[75] Inventor: John H. Vogelzang, Scarborough, Canada

[73] Assignee: Honeywell Limited, Canada

[21] Appl. No.: 160,896

[22] Filed: Feb. 26, 1988

[51] Int. Cl.[4] ..... F23N 5/20

[52] U.S. Cl. ..... 236/11; 165/12; 236/46 E

[58] Field of Search ..... 165/12, 26, 27; 62/180, 62/231; 236/11, 46 R, 46 E, DIG. 9; 98/34.6, 31.6; 219/492

[56] References Cited

U.S. PATENT DOCUMENTS

| | | | |
|---|---|---|---|
| 2,495,861 | 1/1950 | Newton | 165/12 X |
| 3,948,438 | 4/1976 | Vlasak | 165/26 X |
| 4,075,864 | 2/1978 | Schrader | 62/180 |
| 4,369,916 | 1/1983 | Abbey | 236/11 |

*Primary Examiner*—William E. Wayner
*Attorney, Agent, or Firm*—Clyde C. Blinn

[57] ABSTRACT

A temperature conditioning system has a temperature conditioning apparatus such as a heating apparatus or cooling apparatus, an air treatment for cleaning apparatus and a fan for moving air through the temperature conditioning apparatus and air treatment apparatus to supply the conditioning air to a space in which the temperature is controlled by a space thermostat connected to control the heating and cooling apparatuses. The space thermostat has a switch connected through a fan cycler to provide for cycling the fan independent of the operation of the heating and/or cooling apparatus to periodically move air through the air treatment apparatus and throughout the space to insure that the air is periodically treated and moved throughout the space to prevent stagnation when there is no call for operation of the heating and/or cooling apparatus.

2 Claims, 1 Drawing Sheet

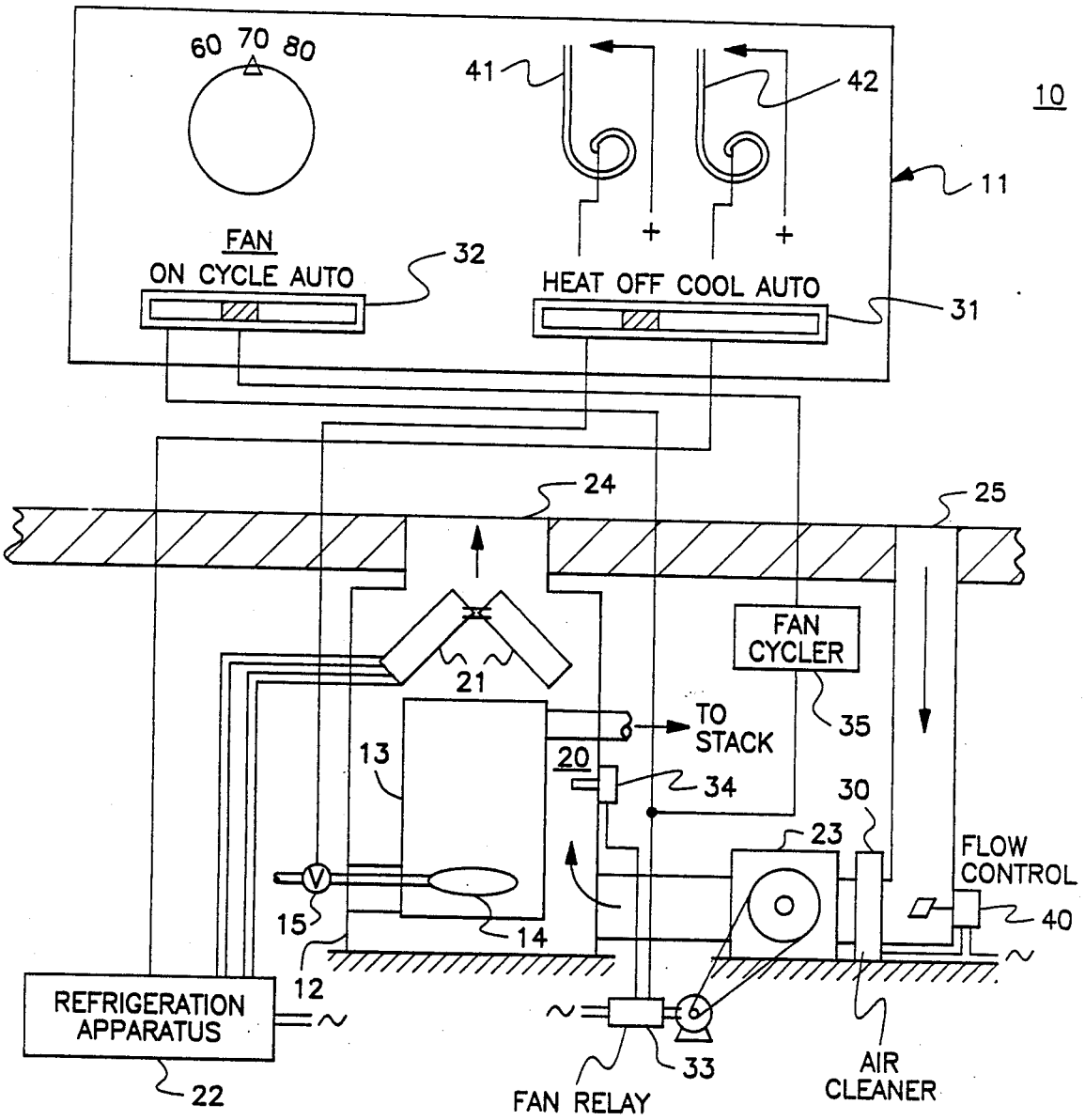
60 70 80
41
42
10
11
FAN
ON CYCLE AUTO
32
HEAT OFF COOL AUTO
31
24
25
FAN
CYCLER
21
TO
STACK
35
13
20
34
30
23
FLOW
CONTROL
15
14
40
12
REFRIGERATION
APPARATUS
22
33
FAN RELAY
AIR
CLEANER

AIR CONDITIONING SYSTEM WITH PERIODIC FAN OPERATION

BACKGROUND AND SUMMARY OF THE INVENTION

For many years temperature conditioning systems have either a furnace or cooling apparatus or both and a fan for moving temperature conditioned air into a space. The control of the heating or cooling apparatus is accomplished by a space thermostat. Associated with the temperature conditioning apparatus might be an air cleaner, such as an electrostatic air cleaner where upon operation of the fan the air from the space passes through the air cleaner and into the space to not only treat the air but move it in the space to prevent stagnation. Normally the fan operates either continuously during the heating period or by energizing the fan from a temperature controller sensing the plenum temperature to bring about an operation of the fan when the plenum temperature reaches some high temperature after operation of the heat source of the furnace. During the cooling operation the fan is generally operated whenever the refrigeration apparatus is operated. During both the heating or cooling operations, there can be long periods of time when no fan operation will take place. Not only is there no movement of air in the space and possible stagnation can take place or spots in which the air may be too cool or too hot, but the air is not treated by the air treating or air cleaning apparatus.

The present invention is concerned with a means for cycling the operation of the fan during periods when there is no operation of the heating apparatus or cooling apparatus. The space thermostat might have a switch for a cycling operation of the fan. When this switch was in the cycle position, the fan would be periodically turned on to provide for the treatment of the air through by the air cleaner and the movement of the air in the space. dr

BRIEF DESCRIPTION OF THE DRAWING

The single drawing is a schematic representation of an air temperature conditioning system having a furnace and cooling apparatus providing heated and cooled air to a space under the control of the space thermostat with a fan for moving the air.

DESCRIPTION OF THE PREFERRED EMBODIMENT

Referring to the single FIGURE, a space 10 of a building or residence contains a temperature responsive control means or thermostat 11 of a conventional type such as shown in U.S. Pat. No. 4,316,577, issued to John T. Adams et al, Feb. 23, 1982 connected to control the operation of a temperature conditioning means or air conditioning apparatus 12. Apparatus 12 has a heat exchanger or furnace 13 such as shown in U.S. Pat. No. 4,373,662 issued to W. W. Bassett et al Feb. 15, 1983 containing a burner to which fuel is supplied by a valve 15 for heating the air in the plenum 20. Also contained in apparatus 12 are cooling coils 21 connected to a refrigeration 22 such as shown in U.S. Pat. No. 4,046,532 issued to L. W. Nelson, Sept. 16, 1977 for cooling the air in the plenum 20. As the air passes through the plenum 20 under the power of an air moving apparatus or a fan 23 when energized by a fan relay 33 the air is supplied by an inlet duct 24 to a space 10 to return to duct 25. Associated with the air temperature conditioning apparatus and fan is a conventional air treating or electrostatic air cleaner apparatus 30 such as shown in U.S. Pat. No. 3,028,715 issued to K.M. Nodolf, Apr. 10, 1962. Air cleaning apparatus 30 is energized when an air responsiveness or flow switch 40 senses air flow.

Thermostat 11 has a temperature responsive means 41 for controlling the fuel valve or gas valve 15 during the heating operation when a switch 31 is in the heat position and a temperature responsive means 42 controlling the refrigeration apparatus 22 when the switch 31 is in the cool position. Such a change over switch is shown in the U.S. patent issued to N.E. Edelman, et al on June 13, 1976. Automatic change over that is from heating to cooling is provided when switch 31 is in the auto position. A fan switch 32 on thermostat 11 has 3 positions "on", "cycle" and "off".

Most thermostats used in forced air heating and cooling systems, such as a T8600 Chronotherm III sold by Honeywell Inc., provided for "on" and "auto" operation of the fan. When in the "on" position, the fan is operated or energized through a fan relay 33 continuously. When in the "auto" position, during the cool operation, the fan is operated each time the refrigeration apparatus is energized and during the heating operation, the fan is operated from a conventional plenum control 34, such as a L4064 Fan and Limit Controller sold by Honeywell Inc., as soon as the plenum temperature reaches some predetermined temperature such as 170°. In both operations of the air temperature conditioning apparatus for either heating or cooling, there are periods of time when, unless the fan was in the continuous "on" position, the fan would not be operating and air would not pass through the air cleaner and move throughout the space.

To provide for movement of the air for air treatment by the air cleaner and movement in the space periodically at all times, fan switch 32 has a cycle position. A conventional fan cycler 35 is connected to energize the fan relay 33 periodically such as several times an hour to maintain periodic air flow through the air cleaner 30 and to move the air about in the space 10. Cycler 35 might be a motor driven switch or an electronic or a heated bimetal timer to energize relay 33 for a predetermined number of times each hour to cycle fan relay 33 such as, 6 short operations each hour. The motor driven switch or electronic timer is energized when fan switch 32 is in the "cycle" position, as shown.

The embodiments of an invention in which an exclusive property or right is claimed are defined as follows:

1. In a space forced air temperature conditioning system comprising:

a thermostat mounted in a space in which the air is to be conditioned;

air temperature conditioning apparatus remotely located from the space;

circuit means connecting said thermostat to control the operation of said air temperature conditioning apparatus;

air moving fan means connected to said conditioning apparatus for delivering temperature conditioned air through ducts to the space from said air temperature conditioning apparatus to maintain a desired temperature in the space as set by said thermostat;

said air moving fan means normally being operated when said temperature conditioning apparatus is energized;

cycling means connected to said air moving means and connected to be controlled by a switch on said thermostat to cycle said air moving means to periodically deliver air to said space when said conditioning apparatus is not operating.

2. An improvement in a space temperature control system wherein a space thermostat controls a remote temperature conditioning apparatus to deliver temperature conditioned air by means of a fan to a space wherein there is a need to have movement of air in the space for comfort when normal operation of the fan is not taking place, the improvement comprising:

manually operated switch means mounted on the space thermostat;

cycling switch means connected to the fan to cycle the fan operation independent of the operation of the temperature conditioning apparatus;

circuit means connected said manually operated switch means to said cycling switch means for cycling the fan to maintain movement of air in the space even though the temperature conditioning apparatus is not operating.

* * * * *